US009303558B2

(12) United States Patent
Blackstock

(10) Patent No.: US 9,303,558 B2
(45) Date of Patent: Apr. 5, 2016

(54) VARIABLE COMPRESSION RATIO ENGINE

(71) Applicant: Scott Blackstock, Thomaston, GA (US)

(72) Inventor: Scott Blackstock, Thomaston, GA (US)

( * ) Notice: Subject to any disclaimer, the term of this patent is extended or adjusted under 35 U.S.C. 154(b) by 2 days.

(21) Appl. No.: 14/067,492

(22) Filed: Oct. 30, 2013

(65) Prior Publication Data

US 2014/0116395 A1 May 1, 2014

Related U.S. Application Data

(60) Provisional application No. 61/720,113, filed on Oct. 30, 2012, provisional application No. 61/772,987, filed on Mar. 5, 2013.

(51) Int. Cl.

| | |
|---|---|
| ***F02D 41/30*** | (2006.01) |
| ***F02B 75/04*** | (2006.01) |
| ***F02D 15/04*** | (2006.01) |

(52) U.S. Cl.

CPC ..... *F02B 75/041* (2013.01); *F02B 75/04* (2013.01); *F02D 15/04* (2013.01); *F02D 2700/03* (2013.01)

(58) Field of Classification Search

CPC ..... F02B 75/041; F02B 75/04; F02D 15/04; F02D 2700/03

USPC ..... 123/48 C, 78 C

See application file for complete search history.

(56) References Cited

U.S. PATENT DOCUMENTS

| | | | | |
|---|---|---|---|---|
| 673,259 | A | 4/1901 | Hautier | |
| 1,896,098 | A | 2/1933 | Poyer | |
| 2,354,357 | A * | 7/1944 | Barthelemy | 123/274 |
| 4,515,113 | A | 5/1985 | DeLorean | |
| 8,166,929 | B2 | 5/2012 | Pattakos et al. | |
| 2008/0178857 | A1 * | 7/2008 | Kamiyama | 123/78 C |
| 2010/0163002 | A1 * | 7/2010 | Kamiyama | 123/48 C |
| 2010/0192917 | A1 * | 8/2010 | Akihisa et al. | 123/48 C |
| 2010/0192919 | A1 * | 8/2010 | Sawada et al. | 123/48 C |
| 2011/0114063 | A1 * | 5/2011 | Akihisa et al. | 123/48 C |
| 2011/0290217 | A1 * | 12/2011 | Kimura et al. | 123/48 C |
| 2011/0290218 | A1 | 12/2011 | Yoshioka | |
| 2012/0080012 | A1 | 4/2012 | Kodama | |
| 2012/0215423 | A1 | 8/2012 | Sakayanagi et al. | |
| 2014/0123959 | A1 | 5/2014 | Blackstock | |

OTHER PUBLICATIONS

Office Action for U.S. Appl. No. 14/067,506 mailed on Jan. 22, 2015, 8 pages.

International Search Report and Written Opinion dated Mar. 28, 2014.

* cited by examiner

*Primary Examiner* — Marguerite McMahon

(74) *Attorney, Agent, or Firm* — Lee & Hayes, PLLC; Robert R. Elliott, Jr.

(57) ABSTRACT

A system and method for providing a variable compression ratio internal combustion engine is disclosed. The system can include a frame affixed to the engine crankcase and a complementary frame affixed to the block/cylinder head assembly. The system can further comprise an actuating system to enable the block/head assembly to be moved up and down with respect to the crankcase, varying the compression ratio of the engine. A number of mechanisms can be used to achieve this movement, including a rack and pinion, a hydraulic or pneumatic actuator, and a gear drive. The compression ratio can be varied continuously during use. The frames substantially limit movement of the engine components to the y-axis, thus reducing, or eliminating, unwanted movement and stresses in other directions.

18 Claims, 16 Drawing Sheets

VARIABLE COMPRESSION RATIO ENGINE

CROSS REFERENCE TO RELATED APPLICATIONS

This application claims priority to and benefit under 35 USC §119(e) of U.S. Provisional Patent Application Ser. Nos. 61/720,113, filed Oct. 30, 2012, and 61/772,987, filed Mar. 5, 2013, both entitled "Variable Compression Engine." Both applications are hereby incorporated by reference as if fully set forth below.

BACKGROUND OF THE INVENTION

1. Field of the Invention

Embodiments of the present invention relate generally to internal combustion engines and, specifically to internal combustion engines with mechanisms for varying the compression ratio.

2. Background of Related Art

In a reciprocating internal combustion engine, the compression ratio of an engine is defined as the ratio between the free volume of the cylinder when the piston is at bottom-dead-center (BDC) to the free volume when the piston is at top-dead-center (TDC). All other things being equal, engines tend to be more efficient and produce more power when run at higher compression ratios because this results in higher thermal efficiency. Diesel engines, for example, run at very high compression ratios (18:1 and higher) resulting in compression ignition (i.e., spark plugs or other ignition sources are not required to light the fuel). The higher compression ratio of diesel engines, along with the slightly higher heat content of diesel fuel, results in an engine that provides significantly better fuel mileage than a comparable gasoline engine.

In a gasoline engine, however, increasing the compression ratio is limited by pre-ignition and/or "knocking." In other words, if the compression ratio is high enough then, like a diesel, the compression of the fuel causes it to ignite (or, "pre-ignite) before the spark plug fires. This can result in damage to the engine because cylinder temperatures and pressures spike as the fuel/air mixture explodes on multiple fronts, rather than burning uniformly. The maximum acceptable compression ratio in an engine is limited by a number of factors including, but not limited to, combustion chamber and piston design, cylinder and piston cooling, engine loading, and air temperature and humidity. The maximum compression ratio used in production engines is generally relatively conservative (on the order of 10.5:1 for cars and 12.5:1 for motorcycles) to account for, for example, the wide variety of operating conditions and fuel quality.

Due to difficulties associated with reliably moving components in an operating internal combustion engine, however, all currently mass produced engines operate with a fixed compression ratio. As a result, the stock compression ratio tends to be a compromise between a high-compression ratio, which is more efficient—but can result in the aforementioned knocking—and a low compression ratio engine—which is more forgiving of, for example, poor quality fuels, high loads, and/or high temperatures.

The ability to change compression ratio during operation can improve fuel efficiency 35-40% and more. When under light load, for example, such as when the vehicle is cruising down the highway, the compression ratio can be increased significantly to increase fuel mileage. When the engine is under a heavy load, ambient air temperature is very high, or fuel quality is low, on the other hand, the compression ratio can be reduced to prevent knocking.

A number of designs exist that have attempted to vary the compression ratio of an internal combustion engine in use. Patents have been filed on variable compression ratio (VCRE) engines for over 110 years. A few of the proposed VCRE engines are based on the concept of raising and lowering the cylinder block/head assembly portion of an engine relative to the crankcase. In this configuration, the distance between the piston at top-dead-center (TDC) and the cylinder head can be varied, thus varying the compression ratio of the engine.

Prior inventions based on raising and lowering the cylinder block/head assembly relative to the crankcase have not been practical for use in moving vehicles, however. Prior inventions allowed the cylinder block/head assembly to move in substantially all directions (i.e., as opposed to limiting movement to the Y axis, or perpendicular to the crankshaft), resulting in severe side loading and premature component failure. Other previous mechanisms have separated the cylinder sleeve from the crankcase, used heavy control mechanisms, or have prevented the location of engine mounts above the center of gravity of the engine leading to stability issues. Still other inventions have incorporated a continuous and closed crankcase housing extending above a traditional crankcase and enclosing the cylinder block, for example, which was heavy and created challenges in eliminating the heat generated by the engine. Finally, prior art solutions have eliminated the critical role cylinder head bolts play in transferring forces between the cylinder head, cylinder block, and crankcase.

What is needed, therefore, is a system for varying the compression ratio of an internal combustion engine without unnecessarily increasing the weight or complexity of the engine. The system should enable the block and head assembly to move vertically with respect to the crankcase, while substantially constraining the engine in all other directions. The system should use conventional manufacturing techniques to provide easily manufacturable, reliable engines with, among other things, improved power-to-weight ratios and fuel consumption. It is to such a system that embodiments of the present invention are primarily directed.

BRIEF SUMMARY OF THE INVENTION

Embodiments of the present invention relate generally to internal combustion engines and more specifically to a system and method for providing an internal combustion engine with variable compression ratio. The system can comprise an interlocking cylinder head/block frame and a crankcase frame. The system enables the cylinder head/block assembly to move up and down in the y-axis to adjust the distance of the head from the crankshaft and, thus, the compression ratio, while substantially preventing movement of the head/block assembly in the x- and z-axes.

The system can use a variety of mechanical, electrical, hydraulic, or pneumatic devices to effect the movement of the head/block assembly. In some embodiments, the system can comprise a rack and pinion system with a ramped guide slot. In other embodiments, the system can comprise an eccentric cam adjuster. In still other embodiments, the system can use a gearset with an offset axis. In yet other embodiments, the system can comprise an offset gear and pulley system with tensioning springs.

Embodiments of the present invention can comprise a system for providing a variable compression ratio engine comprising a first frame affixed to the cylinder head/block assembly of a reciprocating internal combustion engine and a second frame affixed to the crankcase of the engine and in slideable engagement with the first frame. In this manner, the first frame and the second frame can enable the head/block assembly to move vertically (i.e., in the y-axis) with respect to the crankcase, but substantially prevent movement in the other two directions (i.e., the x- and z-axes).

In some embodiments, the first frame can comprise one or more locating slots and the second frame can comprise one or more locating pins in slideable engagement with the one or more locating slots, or vice-versa. In some embodiments, the first frame can be bolted to the cylinder head/block assembly while the second frame can be bolted to the crankcase. In other embodiments, the first frame can be integral to the cylinder head/block assembly while the second frame can be integral to the crankcase.

Embodiments of the present invention can also comprise a variable compression ratio engine system including a cylinder head/block assembly comprising: a cylinder block and a cylinder head detachably coupled to the cylinder block, a crankcase in slideable engagement with the cylinder block assembly, a first frame affixed to the cylinder head/block assembly, a second frame affixed to the crankcase and in slideable engagement with the first frame, and a control system for moving the cylinder head/block assembly vertically (i.e., in the y-axis) with respect to the crankcase. In this configuration, the first frame and the second frame can enable the head/block assembly to move vertically with respect to the crankcase, but substantially prevent movement in the other two directions (i.e., the x- and z-axes). In this manner, moving the cylinder head/block assembly closer to the crankcase increases the compression ratio of the engine while moving the cylinder head/block assembly farther from the crankcase decreases the compression ratio of the engine.

Embodiments of the present invention can also comprise a control system including a block control post coupled to the second frame, a drive motor with a drive gear coupled to the first frame, and a guide plate. The guide plate can comprise, for example, a rack for geared engagement with the drive gear, and an angled slot in slideable communication with the block control post, with a first, lower end and a second, higher end. The guide plate can be slideably coupled to the first frame with a first position and a second position.

In some embodiments, the drive gear can move the guide plate between the first position and the second position. In addition, the first end of the angled slot can be aligned with the block control post in the first position and the second end of the angled slot is aligned with the block control post in the second position. In other words, the first position configures the engine for high compression ratio (HCR) mode and the second position configures the engine for low compression ratio (LCR) mode.

In some embodiments, the drive motor can comprise an electric motor. In other embodiments, the drive motor can comprise a hydraulic motor. The hydraulic drive motor can be driven, for example, by one or more of the following: power steering fluid pressure from a vehicle power steering pump, oil pressure from the engine, and/or transmission fluid pressure from a vehicle transmission. In some embodiments, the drive motor can comprise a vacuum motor driven using engine vacuum.

Some embodiments of the present invention can comprise a control system including an eccentric coupled to the first frame, a lever, with a first end and a second end, the first end coupled to the eccentric, an actuator coupled to the second end of the lever and configured to move the lever and the eccentric between a first, lower position and a second, higher position, and a block control post in contact with the eccentric. In some embodiments, the first position can configure the engine for high compression ratio (HCR) mode and the second position can configure the engine for low compression ratio (LCR) mode.

In some embodiments, the actuator can comprise a linear motor, while in other embodiments the actuator can comprise a hydraulic ram. The hydraulic ram can be driven by, for example and not limitation, power steering fluid pressure from a vehicle power steering pump, oil pressure from the engine, and/or transmission fluid pressure from a vehicle transmission.

Some embodiments of the present invention can comprise a control system including a block control post coupled to the second frame, a drive gear coupled to the first frame, a driven gear rotatably coupled to the first frame (with a first position and a second position). In some embodiments, the driven gear can comprise one or more off axis, arcuate slots, in slideable communication with the block control post, each arcuate slot with a first, lower end and a second, higher end. In some embodiments, the drive gear can move the driven gear between the first position and the second position. In this manner, the first end of the driven gear can be aligned with the block control post in the first position and the second end of the driven gear can be aligned with the block control post in the second position. This, in turn, configures the engine for high compression ratio (HCR) mode in the first position and low compression ratio (LCR) mode in the second position.

In some embodiments of the present invention, the system can further comprise one or more locating pins detachably coupled to the crankcase. In addition, the cylinder head/block assembly can further define one or more holes in slideable engagement with the one or more locating pins. In this configuration, the slideable engagement of the locating pins and holes enable the head/block assembly to move vertically (i.e., in the y-axis) with respect to the crankcase, but substantially prevent movement in the other two directions (i.e., the x- and z-axes).

In some embodiments, the control system can further comprise a controller for controlling the position of the block/head assembly with respect to the crankcase and a position sensor for providing position feedback for the block/head assembly to the controller. In some embodiments, the drive motor can comprise a servo motor.

These and other objects, features and advantages of the present invention will become more apparent upon reading the following specification in conjunction with the accompanying drawing figures.

DETAILED DESCRIPTION OF THE INVENTION

Figure 1:
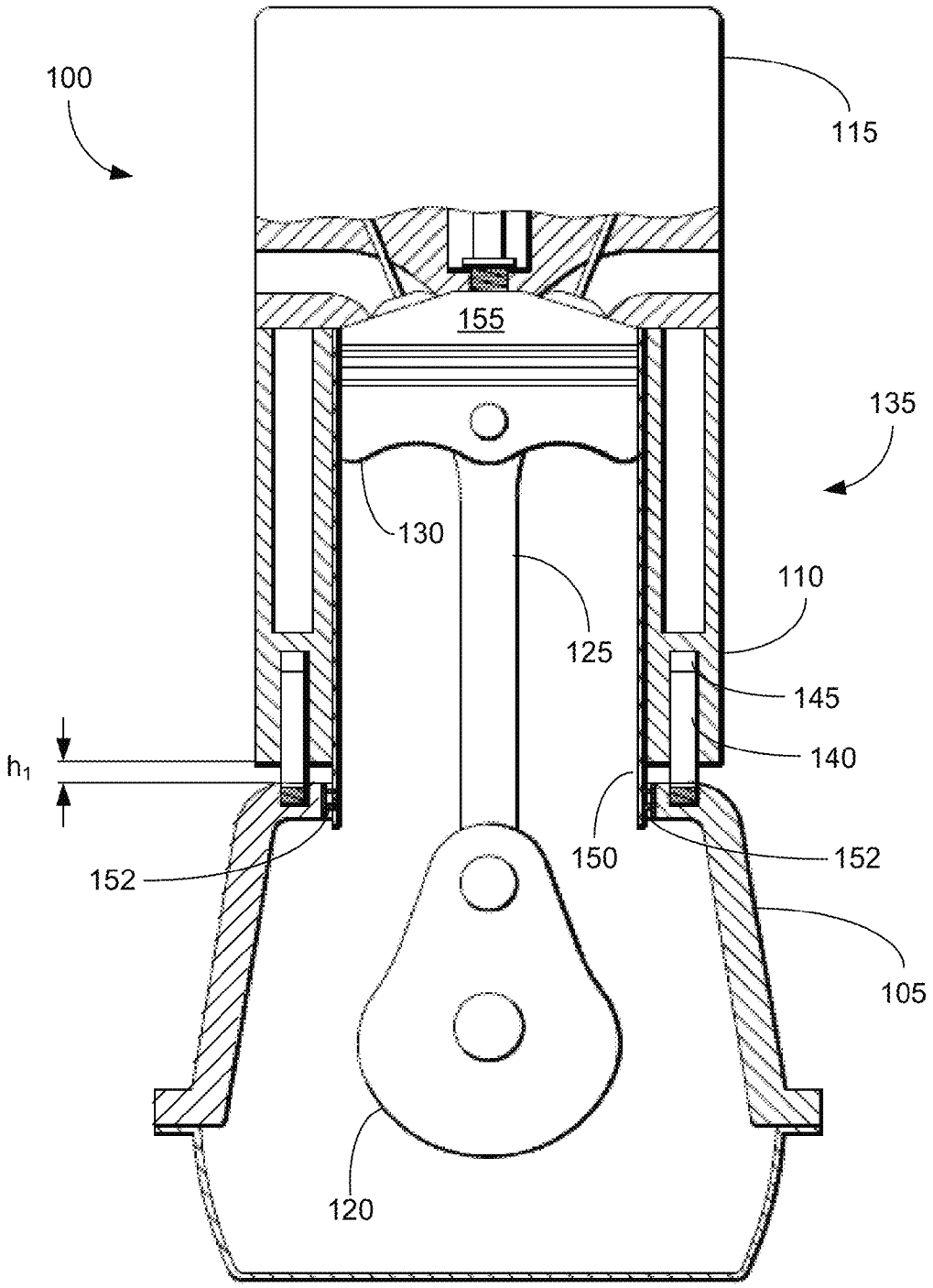
FIG. 1 depicts a cross-sectional detailed view of a variable compression ratio engine (VCRE) in low compression ratio (LCR) mode, in accordance with some embodiments of the present invention.

Embodiments of the present invention relate generally to internal combustion engines and more specifically to a system and method for providing an internal combustion engine with variable compression ratio. The system can comprise interlocking cylinder head/block frame and a crankcase frame. The system enables the cylinder head/block assembly to move up and down in the y-axis to adjust the distance of the head from the crankshaft and, thus, the compression ratio, while substantially preventing movement of the head/block assembly in the x- and z-axes.

The system can use a variety of mechanical, electrical, hydraulic, or pneumatic devices to effect the movement of the head/block assembly. In some embodiments, the system can comprise a rack and pinion system with a ramped guide slot. In other embodiments, the system can comprise an eccentric cam adjuster. In other embodiments, the system can use a gearset with an offset axis. In still other embodiments, the system can comprise an offset gear and pulley system with tensioning springs.

To simplify and clarify explanation, the system is described below as a system for gasoline internal combustion engines. One skilled in the art will recognize, however, that the invention is not so limited. The system can be used in flex fuel vehicles, for example, to provide the optimum compression ratio for each type of fuel. The system can be used to position the cylinder/head block at a first position (on the y-axis) to provide the optimum compression ratio when employing gasoline; for example, but the cylinder head/block can be moved to a second position to provide the optimum compression ratio when methane, ethanol, or other fuel is selected. Using the system in this manner enables the cylinder head/block to be moved while the engine is not running, for example, thus eliminating the need for the control system to overcome the forces of compression and combustion. The system can also be deployed to vary the compression ratio of diesel engines. The system can also be deployed in conjunction with, or instead of, other power engine power adders including, but not limited to, turbochargers, superchargers, nitrous oxide, and alcohol or water injection.

The materials described hereinafter as making up the various elements of the present invention are intended to be illustrative and not restrictive. Many suitable materials that would perform the same or a similar function as the materials described herein are intended to be embraced within the scope of the invention. Such other materials not described herein can include, but are not limited to, materials that are developed after the time of the development of the invention, for example. Any dimensions listed in the various drawings are for illustrative purposes only and are not intended to be limiting. Other dimensions and proportions are contemplated and intended to be included within the scope of the invention.

As described above, a problem with conventional systems and methods for varying the compression ratio in an engine has been that they are excessively heavy, complicated, and unstable. One such example was the Saab Variable Compression (SVC) engine. The engine used a two-piece, hinged crankcase actuated by a hydraulic actuator to vary the distance between the crankshaft and the cylinder head. Unfortunately, the system was extremely expensive to manufacture. In addition, motion control for the engine was so poor that engineers had to idle around turns to prevent engine damage from the induced centrifugal acceleration.

Figure 2:
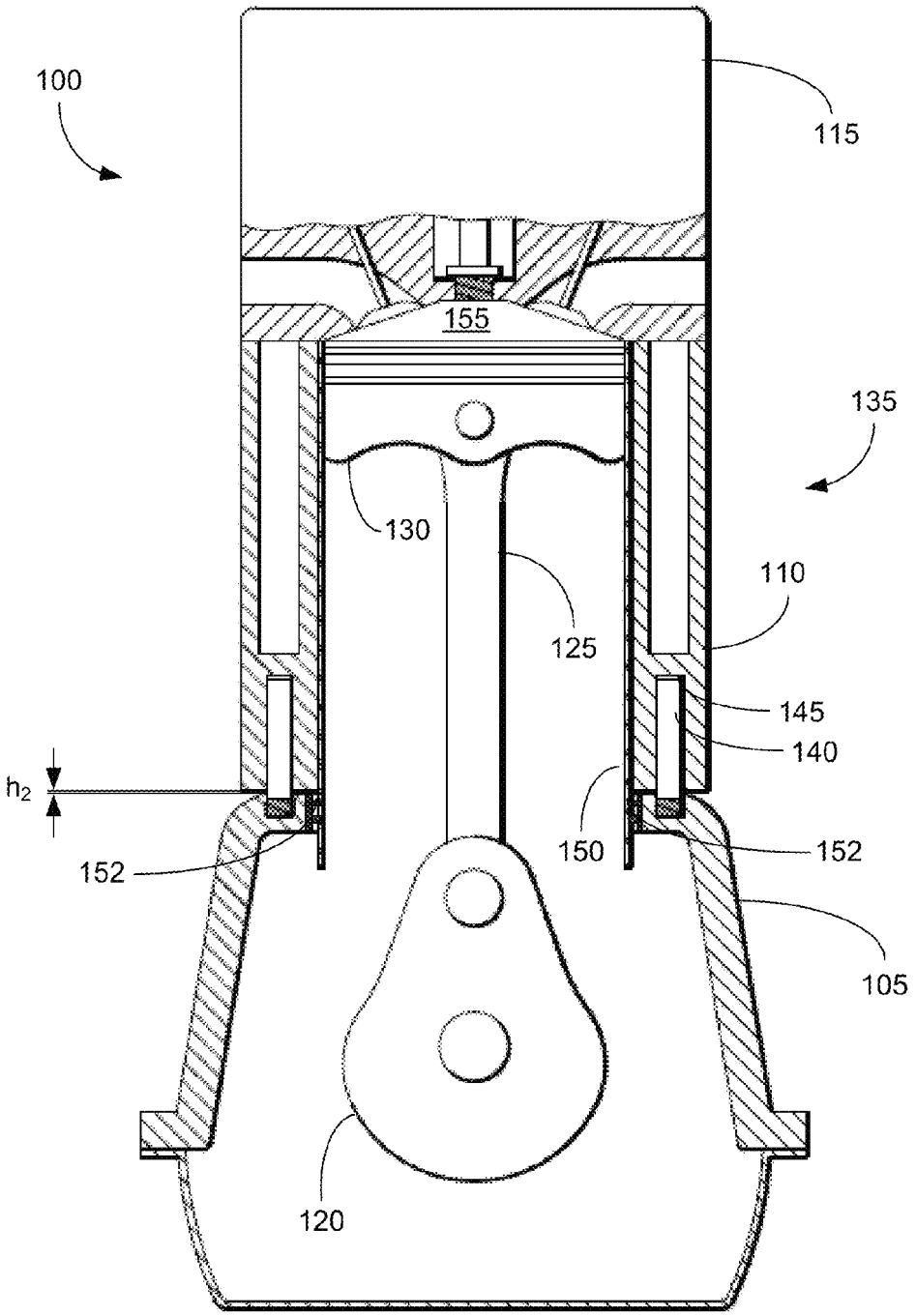
FIG. 2 depicts the VCRE of FIG. 1 in high compression ratio (HCR) mode, in accordance with some embodiments of the present invention.

In response, as shown in FIGS. 1 and 2, embodiments of the present invention relate to a system and method for varying the compression ratio of an internal combustion engine, while stabilizing the moving components thereof. To this end, FIG. 1 depicts a cross-sectional view of a variable compression ratio engine (VCRE) 100 in accordance with some embodiments of the present invention in a low-compression configuration, while FIG. 2 depicts the same engine in a high-compression configuration. As with a conventional engine, the VCRE 100 can comprise a crankcase 105, a cylinder block ("block") 110, and a cylinder head ("head") 115. Inside the crankcase 105, the VCRE 100 can comprise a conventional rotating crankshaft 120, connecting rod 125, and piston 130. In some embodiments, the block 110 and head 115 can be bolted together in the conventional manner, i.e., using large bolts ("head bolts") and a compressible gasket ("head gasket"), to form a head/block assembly 135.

Unlike a conventional engine, however, the head/block assembly 135 on the VCRE 100 can be moved relative to the crankcase 105. In this manner, the distance between the top of the piston 130 and the top of the combustion chamber 155 can be varied to increase or decrease the volume of the combustion chamber 155. This, in turn, varies the compression ratio of the VCRE 100.

To change the compression ratio of the VCRE 100, the cylinder head/block assembly must be moved vertically relative to the crankshaft 120 (and thus, the crankcase 105). This requires, among other things, overcoming the force of gravity (a comparatively small force), inertia, compression, and especially combustion. Controlling these forces has been a major stumbling block for prior designs with a movable cylinder head/block. Ideally, to maintain the geometry of the reciprocating parts 125, 130 and the cylinder bore 150, however, the movement of the head/block assembly 135 should be substantially limited to movement only in the y-axis (i.e., purely vertical movement). As mentioned above, however, a problem with conventional designs is that they have provided poor motion control in the other axes, which can lead to catastrophic failure of the reciprocating components 125, 130, among other things.

In response, embodiments of the present invention can comprise multiple devices, both internal and external to the VCRE 100, to control the movement of the head/block assembly 135. In some embodiments, for example, the block 110 can comprise one or more locating pins 140 for providing internal support. The locating pins 140 can be, for example and not limitation, threaded, welded, cast, or affixed with adhesive into the crankcase 105. The locating pins 140 can ride inside receivers 145 drilled or cast into the block 110 to control the motion of the head/block assembly 135.

In some embodiments, the pins 140 can be lubricated with pressurized or non-pressurized engine oil. In other embodiments, the pins 140 can be lubricated with grease, or other lasting lubricant. In still other embodiments, the pins 140 can be lubricated with a lubricating surface coating such as, for example, Teflon®. In still other embodiments, the pins 140 can ride on a bearing or bushing located in the block or in one or more control mechanisms. Of course, one of skill in the art will recognize that the location of the pins 140 can be reversed (i.e., the pins 140 can be located in the block 110 and the receivers in the crankcase 105).

In other embodiments, the pins 140 can be hydraulic or pneumatic actuators and can provide the force required to move the head/block assembly 135 from the LCR position to the HCR position. The pins 140 can comprise, for example, a hydraulic or pneumatic cylinder with an internal or external spring. When hydraulic or pneumatic pressure is applied to the pin 140, the pin 140 can increase in length and lift the head/block assembly 135 into the LCR position. When pressure is removed from the pins 140, on the other hand, return springs can collapse the pins 140 enabling the head/block assembly 135 to return to the HCR position. Generally, springs are needed only to overcome the forces of gravity when the engine is not running; however, they may also be used to improve control during use. When the engine is running, on the other hand, combustion and compression forces, among other things, exert extreme opposing forces on the crankcase and cylinder block. The forces of inertia, compression, and combustion can be offset by the frames and control mechanisms, discussed below.

In some embodiments, it can be desirable to provide sealing at the junction between the bottom of the block 110 (or the cylinder wall 150) and the crankcase 105 to prevent, for example, oil and combustion gases from escaping. As with conventional engines, virtually all of the combustion gases are contained within the combustion chamber 155 by the piston rings. As a result, the seal between the cylinder wall 150 and the crankcase 105 is only necessary to contain oil and the low pressure gases that bypass the rings (so-called, "blow-by"). In other words, the pressure against this seal is no more than that normally found in a crankcase in a conventional engine and can be further reduced using a conventional positive crankcase ventilation (PCV) system, for example.

In some embodiments, therefore, a seal 152 can be provided between the crankcase 105 and the cylinder wall 150. In some embodiment, the seal 152 can be a standard lip seal, such as those used for rear main seals or camshaft front seals. In other embodiments, the seal 152 can comprise, for example and not limitation, a multi-lip seal, a rope seal, silicone, a machined surface, or other suitable sealing surface. In a preferred embodiment, the seal 152 comprises one or more piston rings and/or one or more oil control rings, such as those used to seal the piston 130 to the cylinder walls 150.

Figure 3:
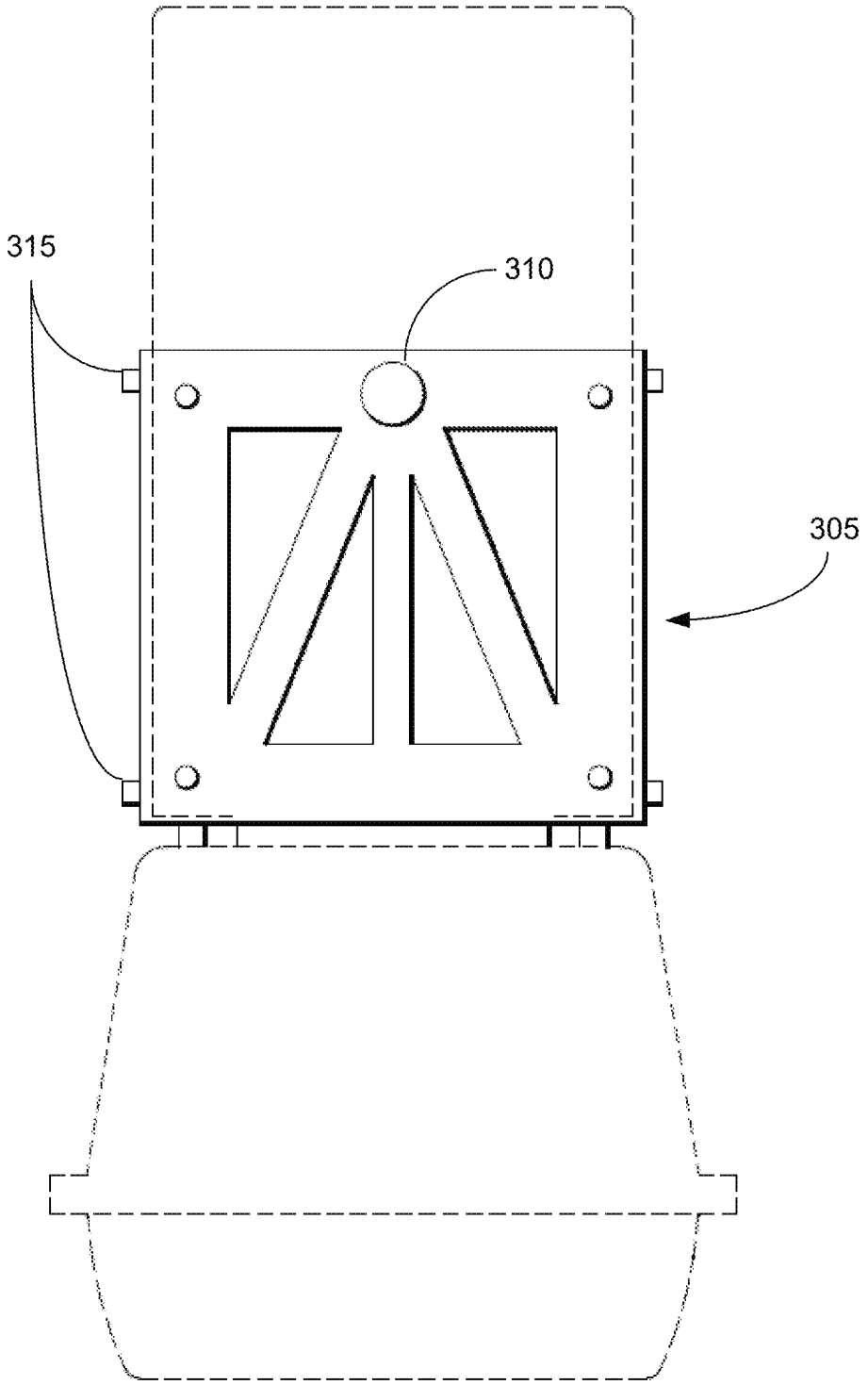
FIG. 3 depicts a cylinder head/block frame for use with the VCRE, in accordance with some embodiments of the present invention.
Figure 4:
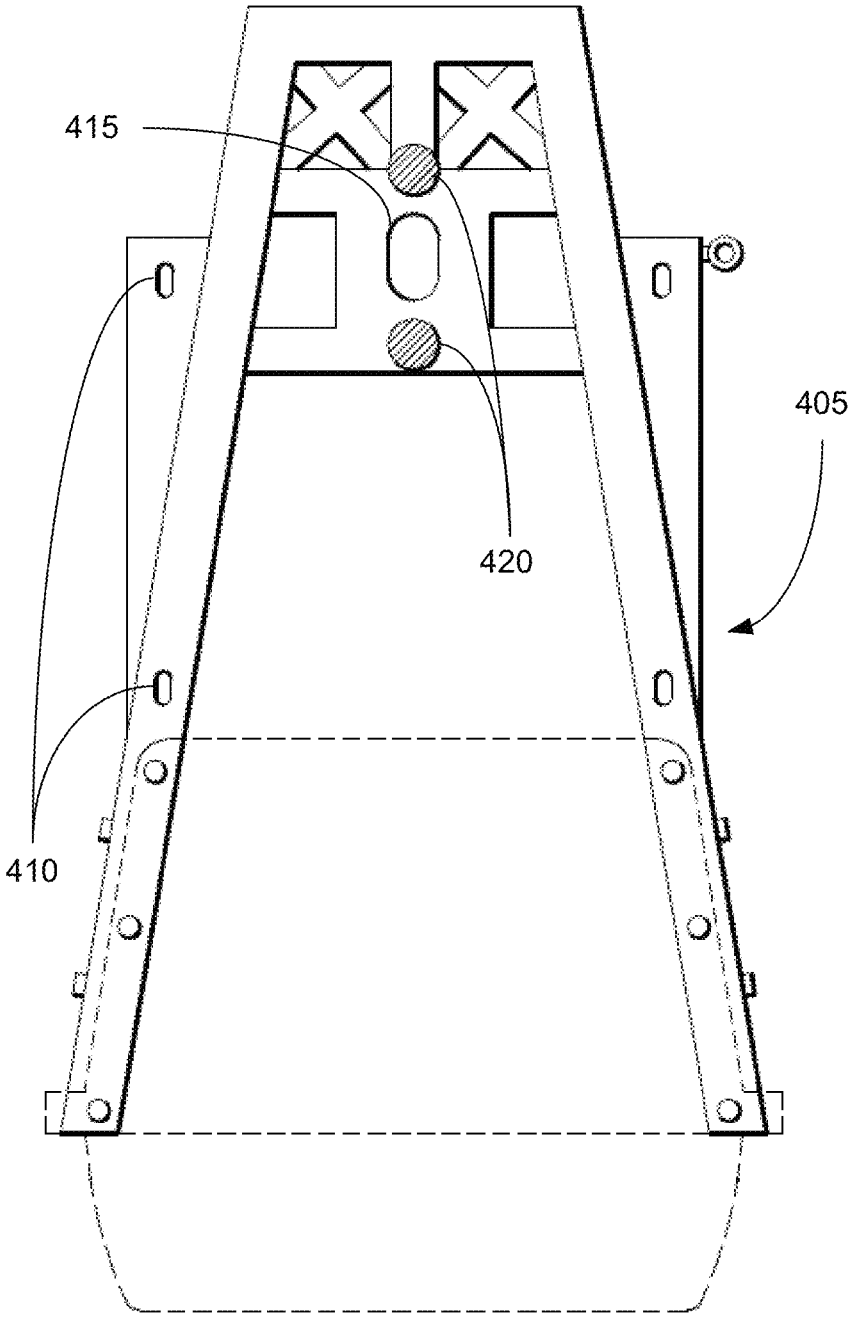
FIG. 4 depicts a crankcase frame for use with the VCRE, in accordance with some embodiments of the present invention.
Figure 11:
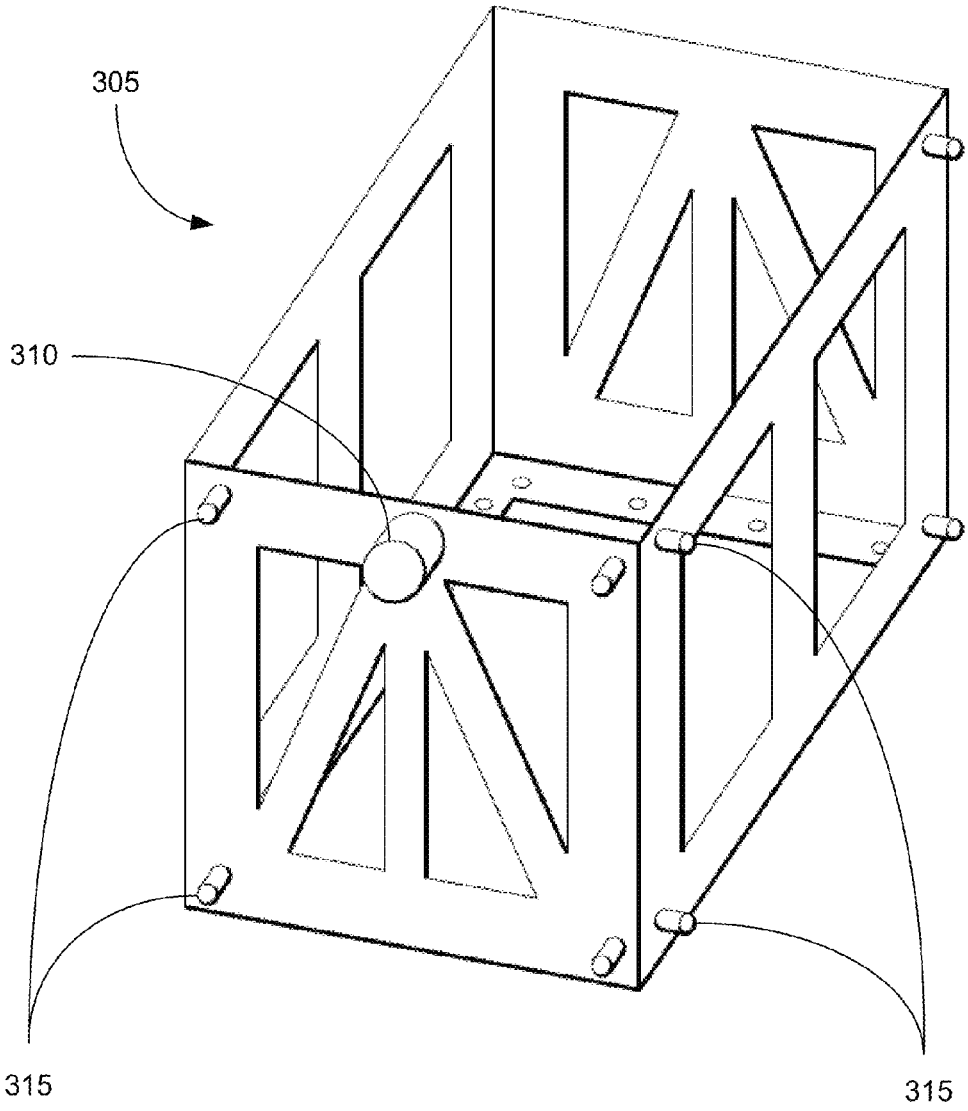
FIG. 11 depicts another view of the cylinder head/block frame of FIG. 3, in accordance with some embodiments of the present invention.
Figure 12:
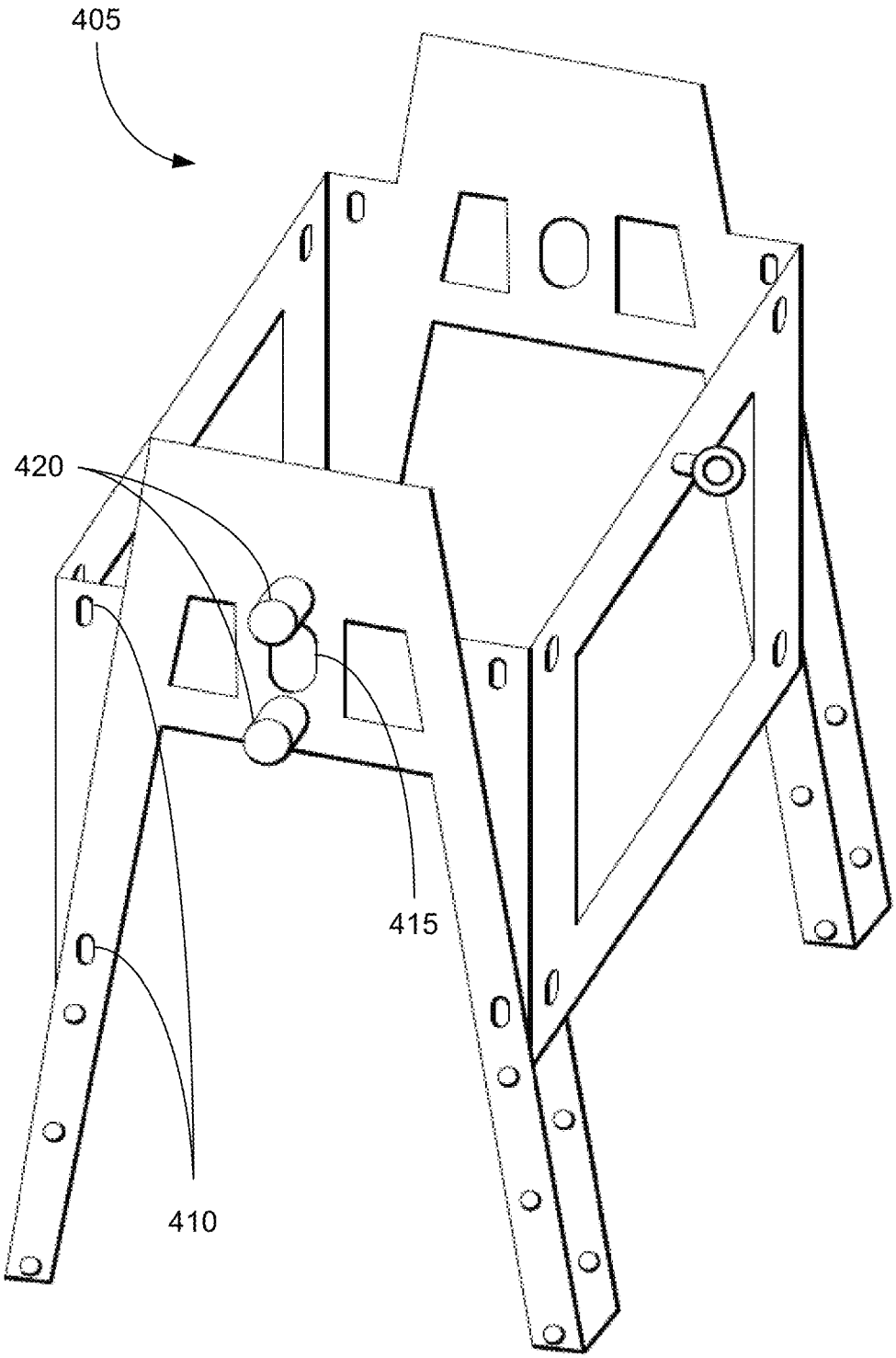
FIG. 12 depicts another view of the crankcase frame of FIG. 4, in accordance with some embodiments of the present invention.

As mentioned above, embodiments of the present invention can provide both internal and external support for the head/block assembly 135 relative to the crankcase 105 to reduce or eliminate undesirable side loading on the reciprocating components 125, 130. To this end, FIGS. 3 and 11 depict a frontal view of a cylinder block frame ("block frame") 305 and FIGS. 4 and 12 depict a frontal view of a complementary crankcase support frame ("crankcase frame") 405. The block frame 305 and crankcase frame 405 enable the head/block assembly 135 to move with respect to the crankcase 105 in the y-axis, while substantially preventing movement in the other two axes (i.e., x- and z-axes with respect to the crank 120). In this manner, regardless of external forces on the VCRE 100, the alignment of the head/block assembly 135 and crankcase 105 (and thus, crankshaft 120) is maintained. For the purpose of illustration, FIGS. 11 and 12 depict bolt on versions of the frames 305, 405. One skilled in the art will recognize, however, that the frames 305, 405 can also be integral to (e.g., integrally cast or machined) into the head/block assembly 135 and crankcase 105, respectively.

The block frame 305 can be, for example and not limitation, attached to or integral to (i.e., machined or cast from the same piece of metal) the head/block assembly 135. In some embodiments, the block frame 305 can further comprise one or more block control posts 310 and one or more guide pins 315. Similarly, the crankcase frame 405 can be attached to (e.g., bolted) or integral to (i.e., machined or cast from the same piece of metal) the crankcase 105. The crankcase frame 405 can comprise one or more guide pin slots 410 sized and shaped to be in slideable engagement with one or more of the guide pins 315 and one or more block control slots 415 sized and shaped to be in slideable engagement with the block control posts 310. In some embodiments, the crankcase frame 405 can further comprise one or more crankcase frame support posts 420 for use with various adjustment mechanisms, as discussed below.

Figure 5:
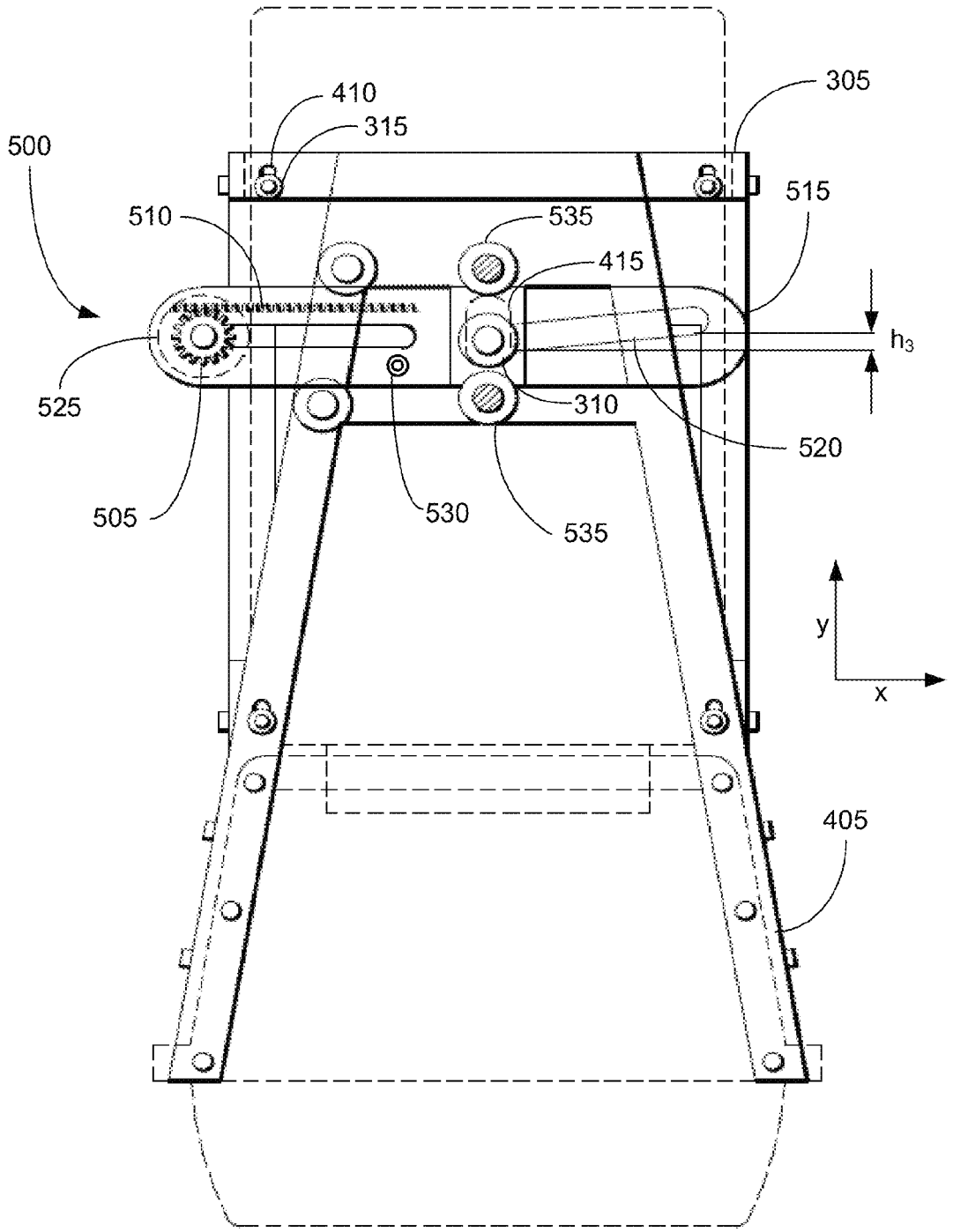
FIG. 5 depicts a rack and pinion type control system for the VCRE in the HCR mode, in accordance with some embodiments of the present invention.

As shown in FIG. 5, the slots 410, 415 in the crankcase frame 405 can slideably engage the pins 310, 315 on the block frame 305 to enable movement in the y-axis (i.e., vertical movement), while reducing or eliminating movement in the x-axis (left and right, or lateral motion, of the VCRE 100) and z-axis (into the page, or longitudinal motion, of the VCRE 100). In this manner, the alignment of the reciprocating components 125, 130 can be maintained improving crankshaft 120, bearing (main and rod), piston 130, and cylinder wall 150 life.

One of skill in the art will recognize that the frames 305, 405 and pins 310, 315 can be designed to be strong enough to resist forces generated by, for example, engine torque, vehicle braking, and centrifugal acceleration from the vehicle turning. Both the frames 305, 405 and the pins 310, 315 can comprise, for example and not limitation, steel, aluminum, iron, titanium, plastic, carbon composites, or combinations thereof. Of course, other materials and combinations of materials are possible and are contemplated herein.

In addition, the pins 310, 315 can be integral to (i.e., machined from billet or cast integrally with) the block frame 305, or can be, for example and not limitation, bolted, welded, swaged, or otherwise attached to the frame 305. In some embodiments, the pins 310, 315 and/or slots 410, 415 can further comprise bushings, lubricants, or bearings to reduce friction and noise when the VCRE 100 is operation. In some embodiments, the pins 310, 315 can comprise nylon bushings, for example, to provide a precise fit in the slots 410, 415, while absorbing vibration and reducing friction. In other embodiments, the pins 310, 315 can comprise bearings or wheels sized and shaped to ride smoothly in the slots 410, 415, while maintaining tight clearances.

In addition, one of skill in the art will recognize that other similar mechanisms can be used to maintain the alignment of the assembly 135 and crankcase 105. A system of interlocking rails or rails and bearings, for example, could be used. In other embodiments, a system of concentric tubes or a rod and tube combination could be used. In other words, a variety of geometries and mechanisms could be used that enable movement between the assembly 135 and the crankcase 105, but substantially prevent movement in the x- and z-axes.

The frames 305, 405 enable the transfer of weight, inertia, compression, and combustion forces from the head/block assembly 135 to the crankcase 105 and, in turn to the vehicle via motor mounts, for example. Importantly, unlike prior art systems that move the cylinder block on the Y-axis in relation to the crankshaft, this also enables the engine mounts to be located above the center of gravity (i.e., on the block frame 305), which tends to reduce rocking and improve stability. This enables, among other things, the VCRE 100 to be mounted in a conventional mounting location, with improved stability and center of gravity.

Figure 6:
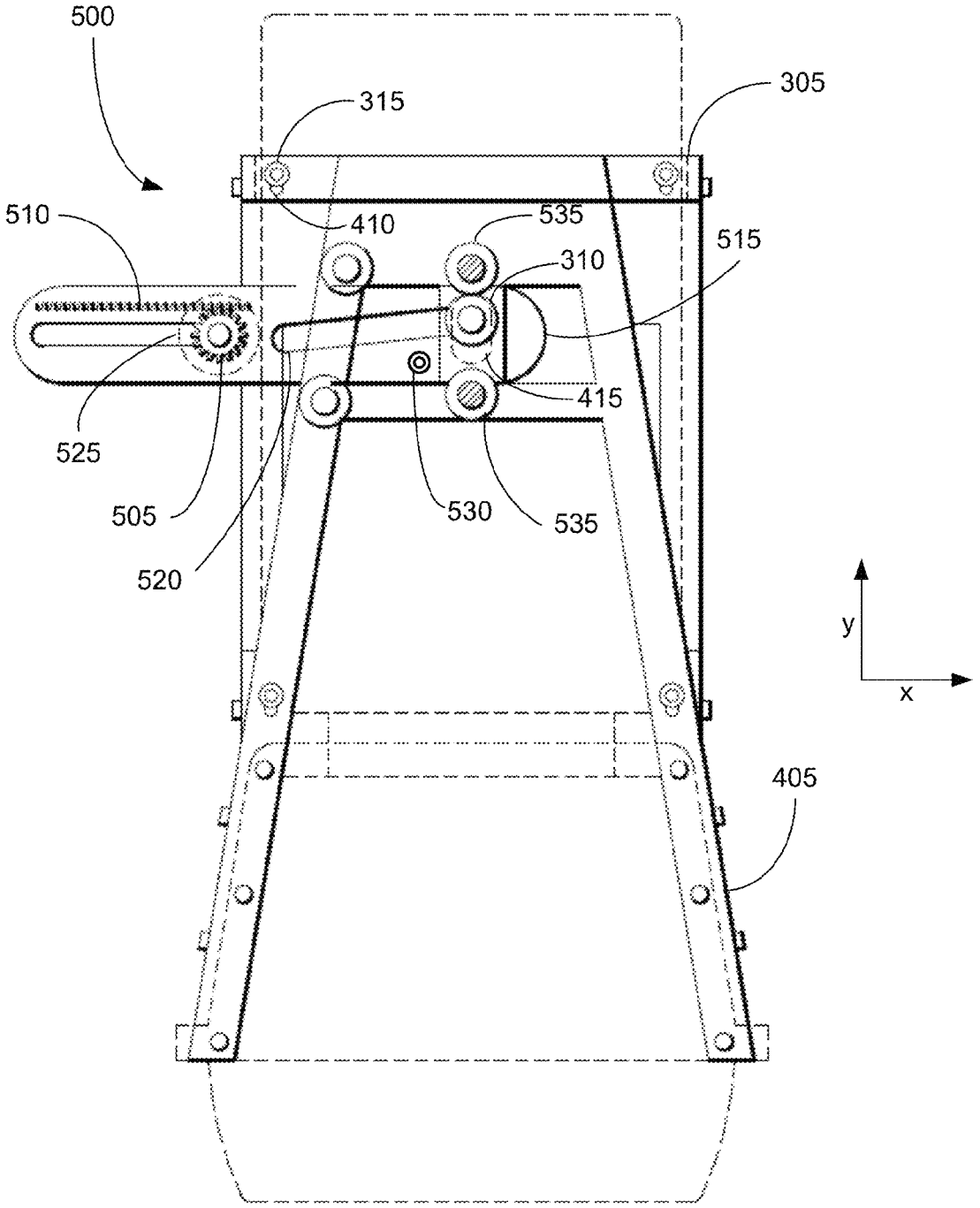
FIG. 6 depicts the rack and pinion type control system in FIG. 5 in the LCR mode, in accordance with some embodiments of the present invention.

As shown in FIGS. 5-10, moving the head/block assembly 135 vertically with respect to the crankcase 105 can be accomplished using a number of mechanisms. As shown in FIGS. 5 and 6, in some embodiments, the head/block assembly 135 can be moved using a rack and pinion positioning system 500. The rack and pinion system 500 can comprise a circular or arcuate gear 505 and a rack 510. The rack 510, in turn, can be mounted on a guide plate 515 with a ramped slot 520. In this manner, when the gear 505 is rotated, the rack 510 can move the guide plate 515 back and forth on the x-axis. As the slot 520 moves to the left, the block control post 310 is moved up or down in the ramped slot 520. The height $h_3$ of the slot 520 controls the distance the head/block assembly 135 is moved relative to the crankcase 105.

The gear 505 can be rotated using a number of mechanisms, or motors 525, including, but not limited to, an electric motor, a hydraulic motor, a pneumatic motor, or vacuum motor. The motor 525 can be driven, for example, using electricity, manifold vacuum, oil pressure from the engine, or power steering or transmission fluid pressure. In this manner, the head/block assembly 135 can be moved from the HCR position (FIG. 5) to the LCR position (FIG. 6). In some embodiments, a servo motor can be used, for example, to enable the motor 525 to be stopped in any position between the HCR and the LCR position (FIG. 6) to enable continuously variable compression ratios. In some embodiments, the VCRE 100 can also use a position sensor 530, or, in the case of a servo motor, the motor 525 itself, to monitor the position of the head/block assembly 135 for continuous computer control. In some embodiments, the system 500 can comprise one or more guides 535 to maintain the alignment and smooth operation of the guide plate 515. The guides 535 can be, for example and not limitation, slots, bearings, or wheels (shown).

Figure 7:
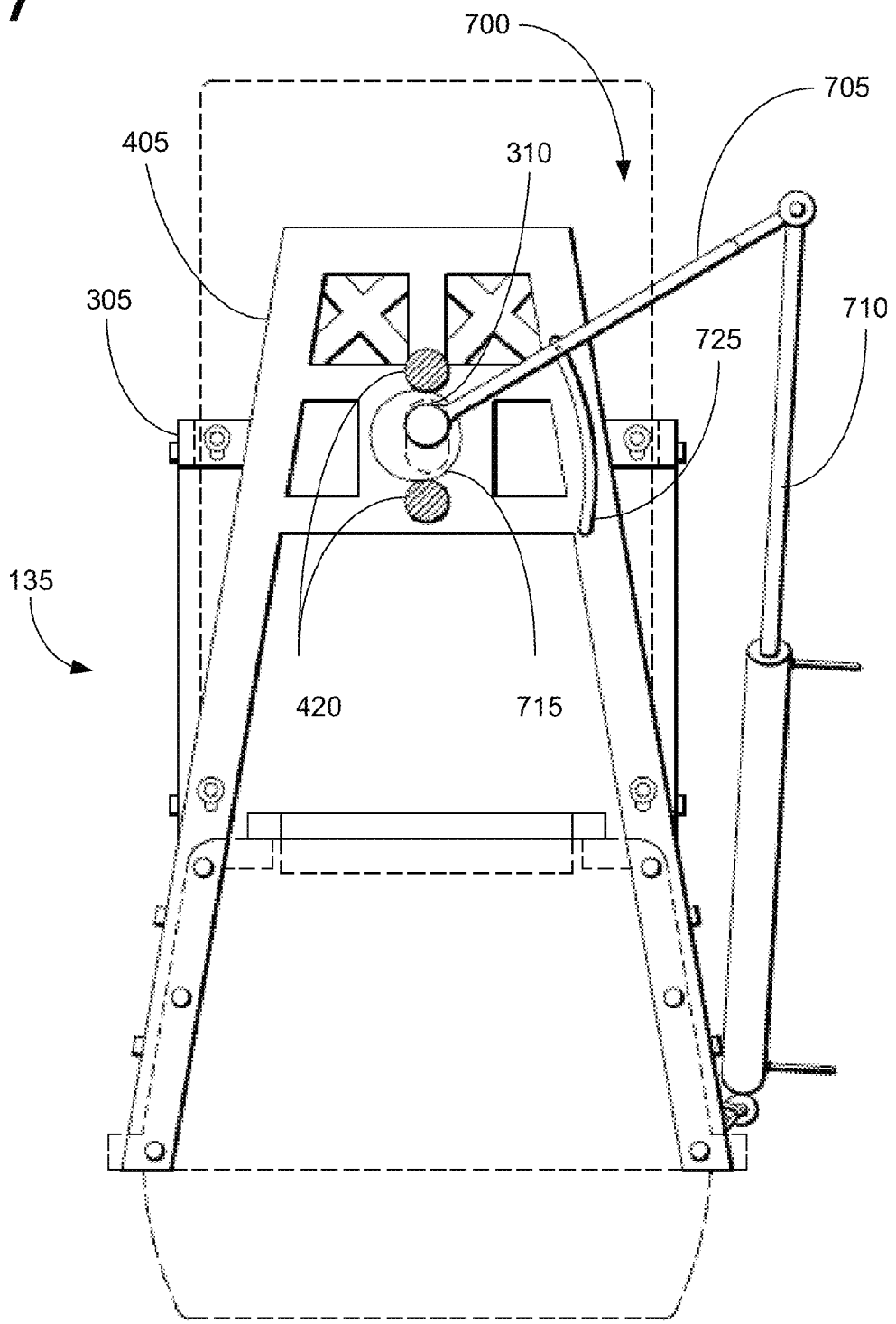
FIG. 7 depicts a lever type control system for the VCRE in LCR mode, in accordance with some embodiments of the present invention.
Figure 8:
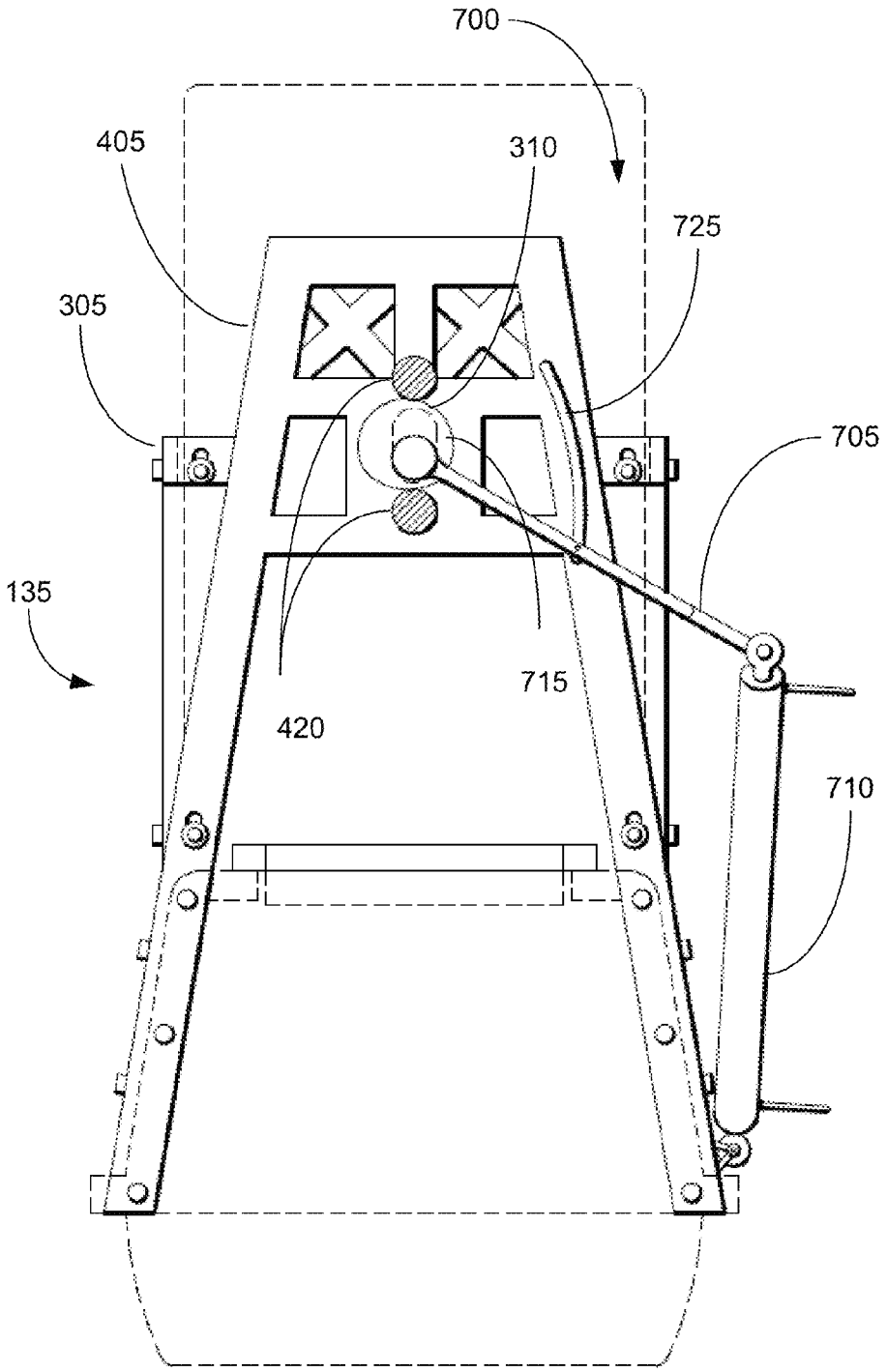
FIG. 8 depicts the lever type control system of FIG. 7 in the HCR mode, in accordance with some embodiments of the present invention.

In other embodiments, as shown in FIGS. 7 and 8, the head/block assembly 135 can be moved using a cam and lever positioning system 700. In some embodiments, the system 700 can comprise a lever 705, an eccentric, or cam 715, and an actuator 710. The cam 715, in turn, can be connected to the block control post 310 and can act on one or more crankcase frame support posts 420. In this configuration, when the lever 705 is moved, the cam 715 acts on the posts 420 to move the head/block assembly 135 from the LCR position (FIG. 7) to the HCR position (FIG. 8) (or vice-versa depending on cam orientation). In some embodiments, the actuator 710 can be, for example, a hydraulic or pneumatic cylinder or a linear servo motor. In other embodiments, the actuator 710 can enable the assembly to be positioned in any position between the HCR position (FIG. 7) to the LCR position (FIG. 8) to enable continuously variable compression ratios. In other embodiments, a servo motor or other means can act directly, or via a gear drive, on the cam 715 to effect movement of the head/block assembly 135.

In some embodiments, the system 700 can also comprise a position sensor 725 to provide feedback related to the position of the head/block assembly 135. The sensor 725 can be, for example, a slot-type potentiometer. In this manner, like ignition and valve timing, the compression ratio of the engine can be continuously varied in response to, for example, load, temperature, and fuel quality. To improve efficiency, for example, the VCRE 100 can be used in conjunction with the vehicle's knock sensor to maximize compression ratio and ignition timing to just below the threshold of knock at all times.

Figure 9:
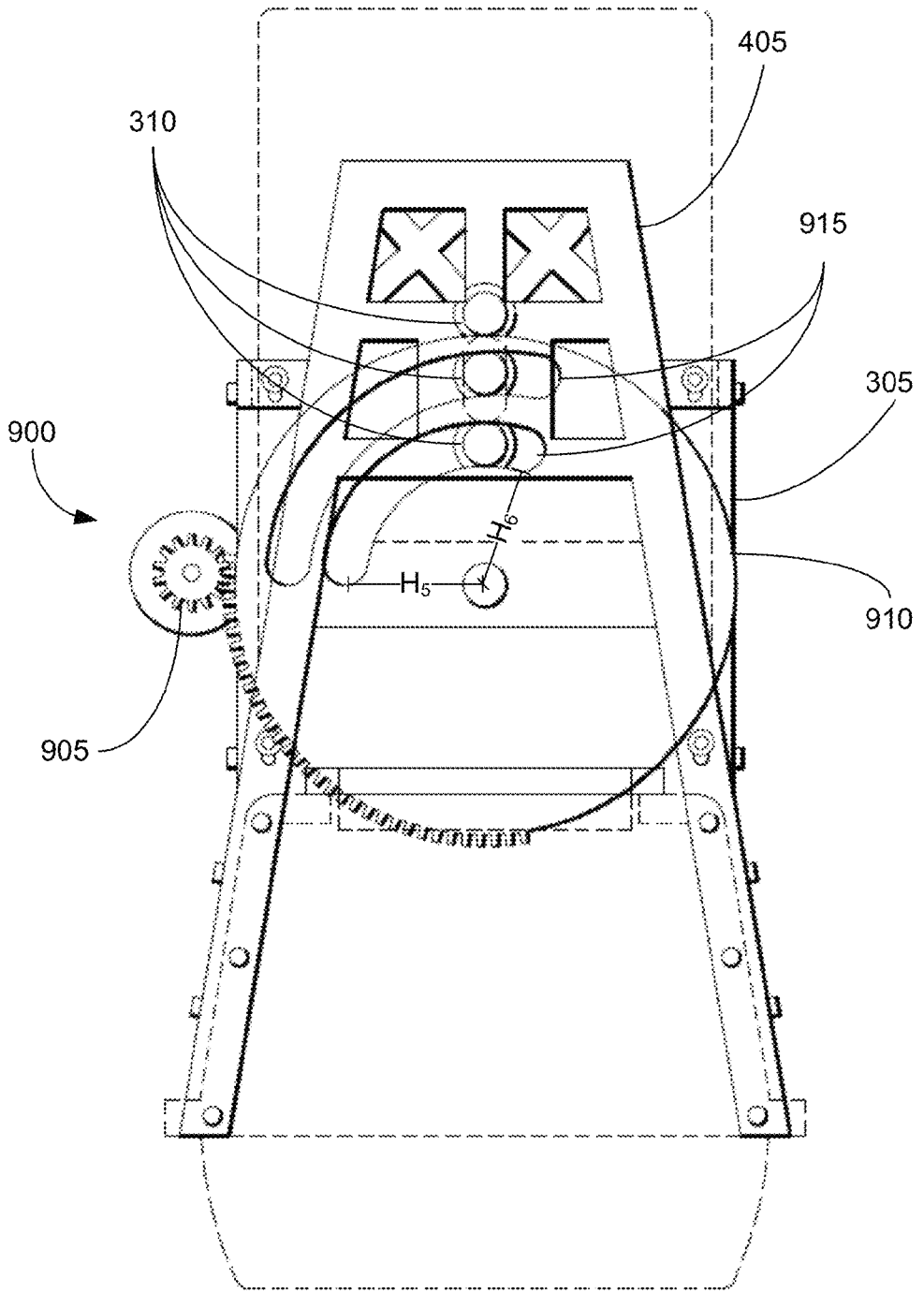
FIG. 9 depicts a gear and slot control system for the VCRE in LCR mode, in accordance with some embodiments of the present invention.

In other embodiments, as shown in FIG. 9, the VCRE 100 can comprise a geared positioning system 900. The system 900 can comprise, for example, a motorized drive gear 905 and a driven gear 910. As shown, the driven gear 910 can comprise one or more offset slots 915. In other words, the slots 915 are not concentric with the gear 910, such that as the gear is rotated, the slots 915 move one or more block control posts 310 closer or farther from the center of the gear 910. This, in turn, moves the head/block assembly 135 a distance ($h_6$-$h_5$) to lower or raise the compression ratio.

Figure 10:
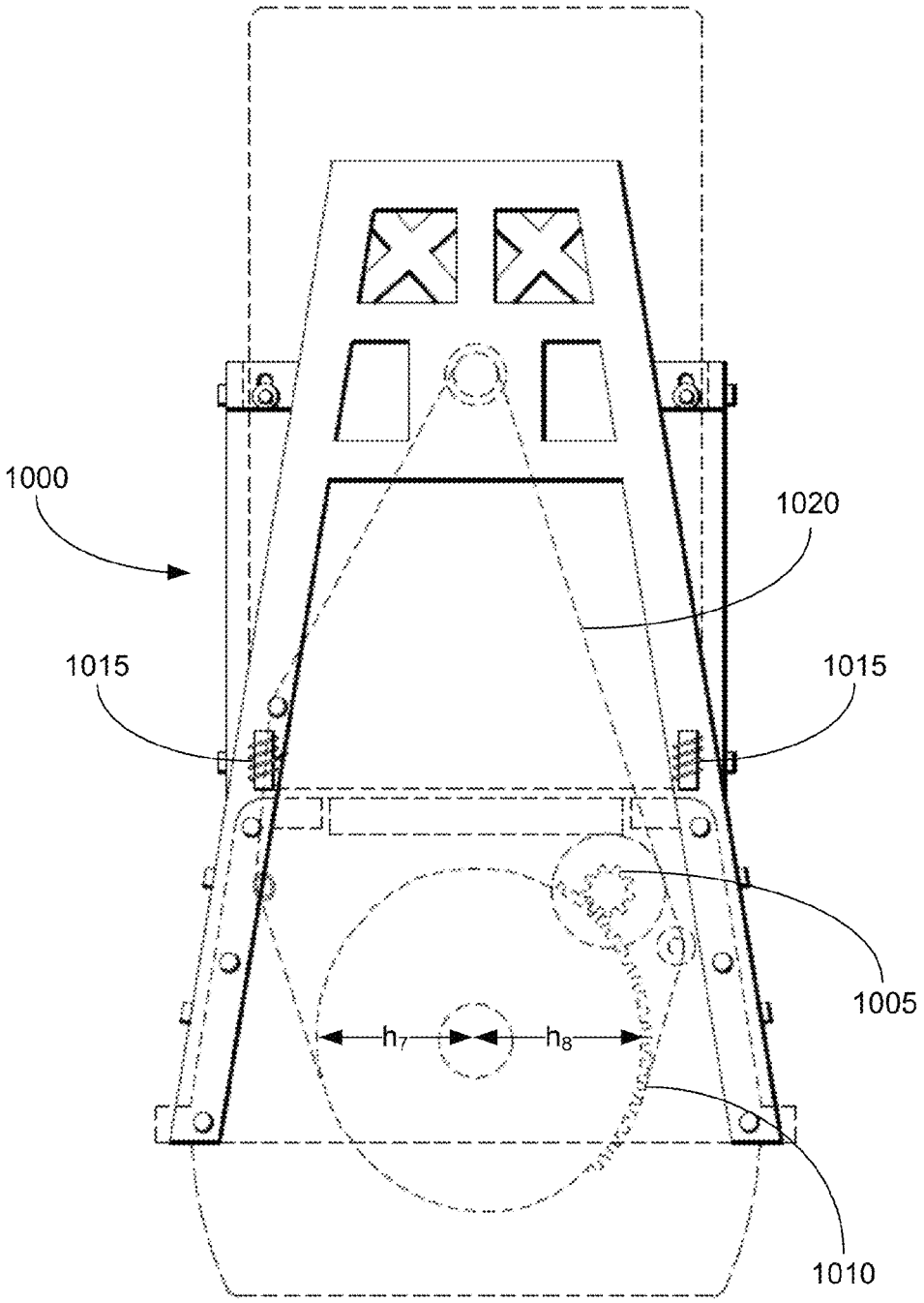
FIG. 10 depicts an internal gear and cable control system for the VCRE in HCR mode, in accordance with some embodiments of the present invention.

FIG. 10 depicts an internal gear and cable positioning system 1000 in accordance with some embodiments of the present invention. Similar to the design in FIG. 9, the system 1000 can comprise, for example, a motorized drive gear 1005 and a driven gear 1010. As shown, the driven gear 1010 can comprise an offset, such that the gear 1010 is attached off center. The gear 1010 can also comprise a groove, or channel, to house one or more cables 1020. The system 1000 can also comprise one or more springs 1015 to hold the head/block assembly 135 in the LCR position when there is little or no tension on the cable 1020. When the gear 1010 is rotated (clockwise in this case), tension on the cable 1020 increases, pulling down on the block control post 310. This, in turn, overcomes the spring 1015 tension and moves the head/block assembly 135 a distance ($h_8$-$h_7$) to raise the compression ratio. The system 1000 can be deployed internally or externally to the cases of the VCRE 100.

Figure 13:
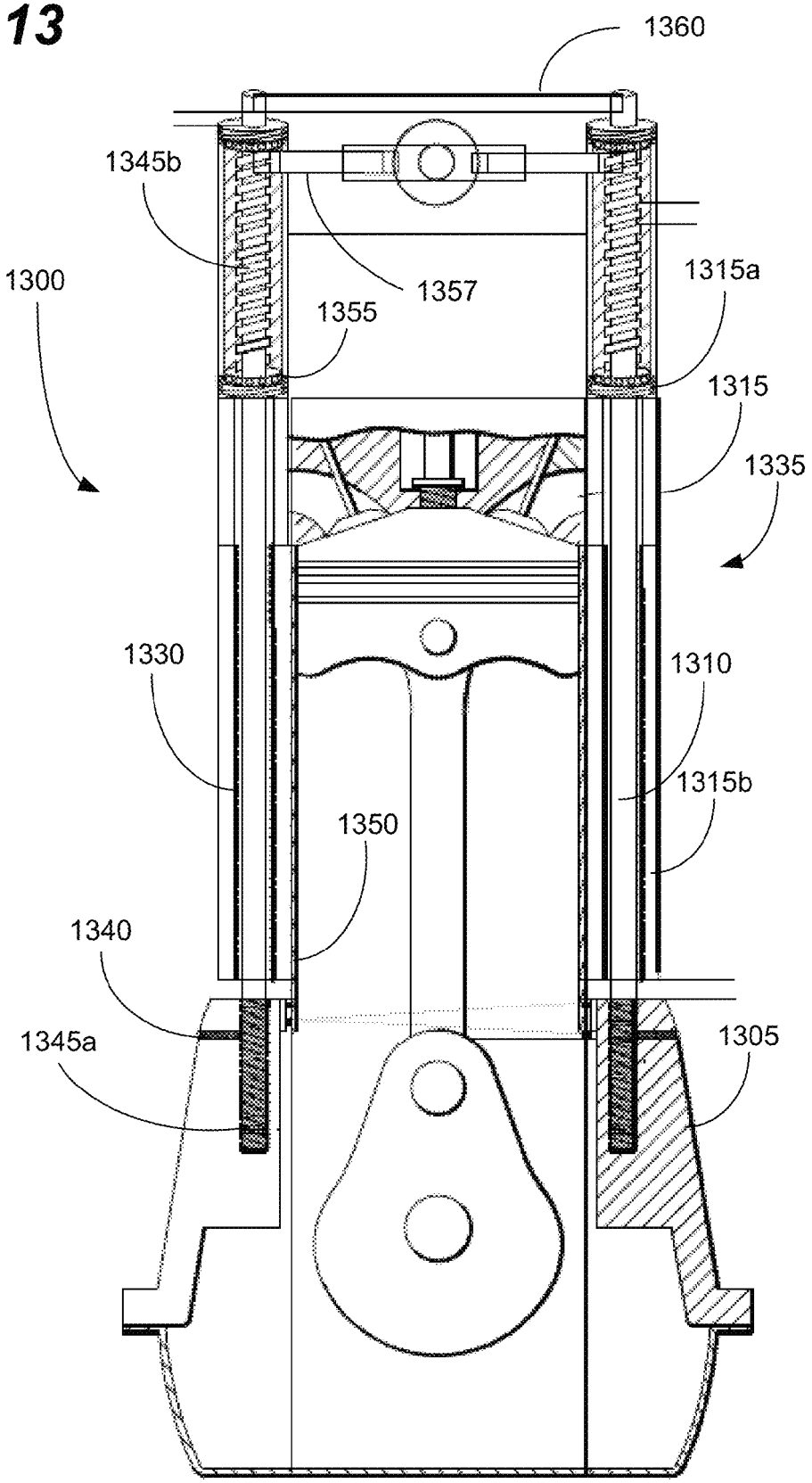
FIG. 13 depicts an internal screw-type actuator for the VCRE, in accordance with some embodiments of the present invention.
Figure 14:
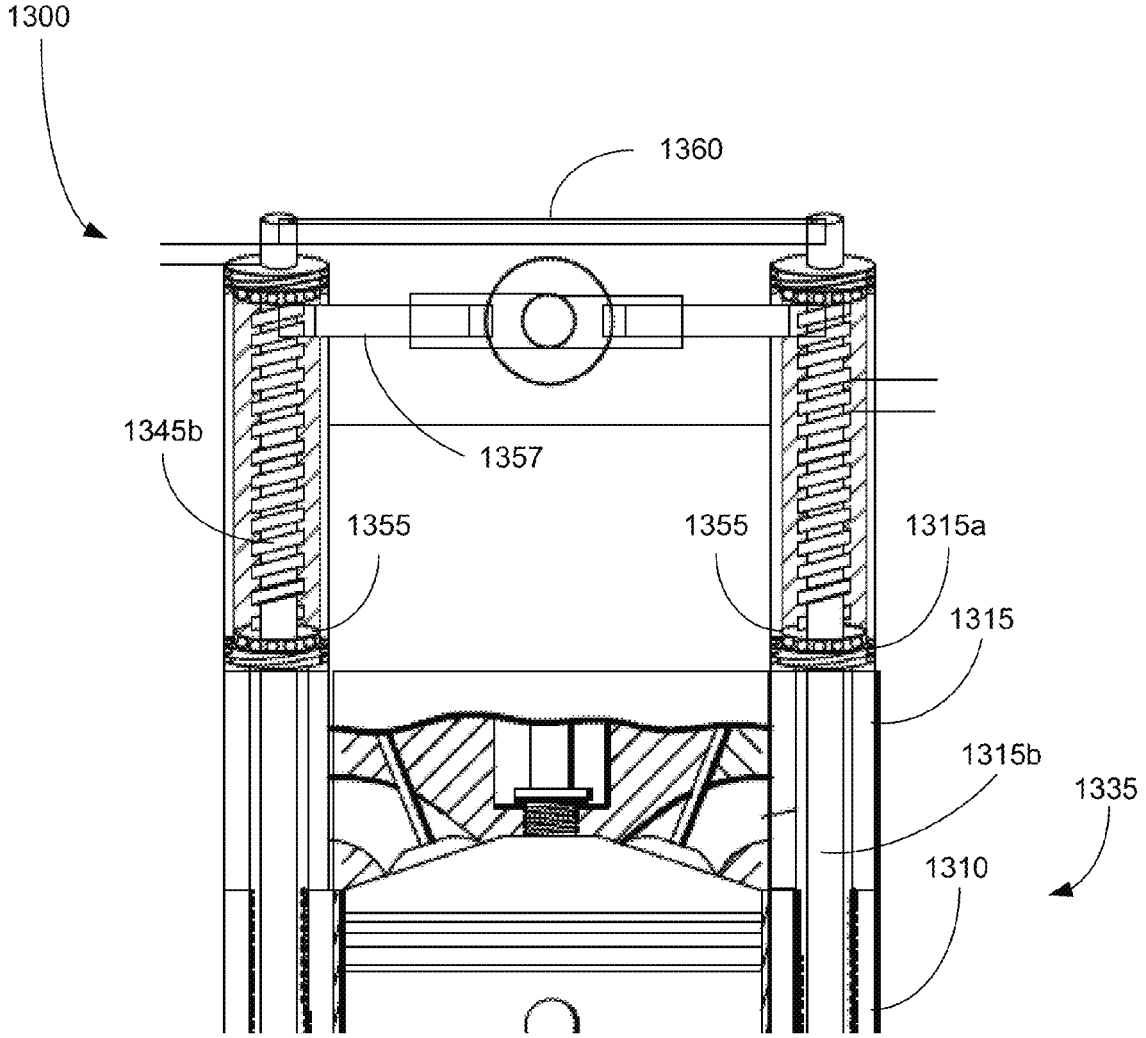
FIG. 14 depicts a detailed view of the internal screw-type actuator of FIG. 13, in accordance with some embodiments of the present invention.

In still other embodiments, as shown in FIG. 13 and in detail in FIG. 14, the system 1300 can comprise an internal screw-drive mechanism. In this configuration, instead of conventional solid head bolts, the cylinder head 1315 and block 1310 can be affixed using hollow cylinder head bolts 1315*a*. The hollow cylinder head bolts 1315*a* can be manufactured from, for example and not limitation, steel, aluminum, or titanium. The bolts 1315*a* can be hollow tubes with external threads, for example, to affix the cylinder head 1315 to the block 1310 in the normal manner (i.e., using a compressible "head gasket"). The bolts 1315*a* can have, for example, an external 6 or 12 point drive head, as is commonly used, or can have an internal, open drive, such as an Allen or Torx®.

The system 1300 can further comprise a plurality of control bolts 1315*b* to affix the head/block assembly 1335 to the crankcase 1305. The control bolts 1315*b* can be threaded into the crankcase 1305 through the control bolt holes 1330 in the head 1315 and block 1310 to provide alignment and control of the assembly 1335. In a preferred embodiment, the control bolts 1315*b* are affixed in the block 1310 and do not move or rotate. In addition, the control bolts 1315*b* preferably fit tightly inside the head bolts 1315*a* and the control bolt holes 1330 in the block 1310, but do not bind. As described below, this can enable the assembly 1335 to move vertically on the control bolts 1315*b*, while the relatively tight tolerances and long interface between the control bolts 1315*b* and control bolt holes 1330, among other things, reduces, or eliminates, motion in the x- and z-axes.

In some embodiments, the control bolts 1315*b* can be affixed with a set screw 1340. In other embodiments, the bolts 1315*b* can be affixed using, for example and not limitation, Loctite® or roll pins. In still other embodiments, the bolts 1315*b* can simply be torqued into the crankcase 1305 at a suitable torque specification.

In other embodiments, the control bolts 1315*b* can comprise two types of threads. The threads 1345*a* located on the bottom of the bolts 1315*b* can be threaded into the block, as described above. The control threads 1345*b* located on the top of the bolts 1315*b*, on the other hand, can be used to control the assembly 1335 vertically during use, as described below.

In some embodiments, the control cylinders 1350 can be in threadable engagement with the control threads 1345*b*. In this manner, when the control cylinders 1350 are rotated, they move up and down the control bolts 1315*b* which, in turn, moves the assembly 1335 up can down (depending on the direction of rotation). In some embodiments, the control cylinders 1350 can further comprise control bearings 1355, or bushings, to enable the control cylinders 1350 to rotate with reduced friction. The control cylinders 1350 can be manufactured from, for example and not limitation, steel, aluminum, or titanium. The control bearings 1355 can be, for example and not limitation, roller bearings, taper bearings, or bronze bushings. In some embodiments, the control bearings 1355 can further comprise a friction lowering coating such as, for example, Teflon®.

In other embodiments, rather than engaging the control bolts 1315*b*, the cylinder head 1315 can comprise one or more threaded holes (not shown) threadably engaged with the external threads on the control cylinders 1350. In this configuration, the control cylinders 1350 can be fixed onto the control bolts 1315*b* using, for example, circlips to enable the control cylinders 1350 to rotate, but not move vertically with respect to the control bolts 1315*b*. In this manner, as the control cylinders 1350 rotate, the move vertically in the external threads cast or machined into the cylinder head 1315 and, because the cylinders 1350 are fixed on the bolts 1315*b*, the cylinder head 1315 moves vertically.

Figure 15:
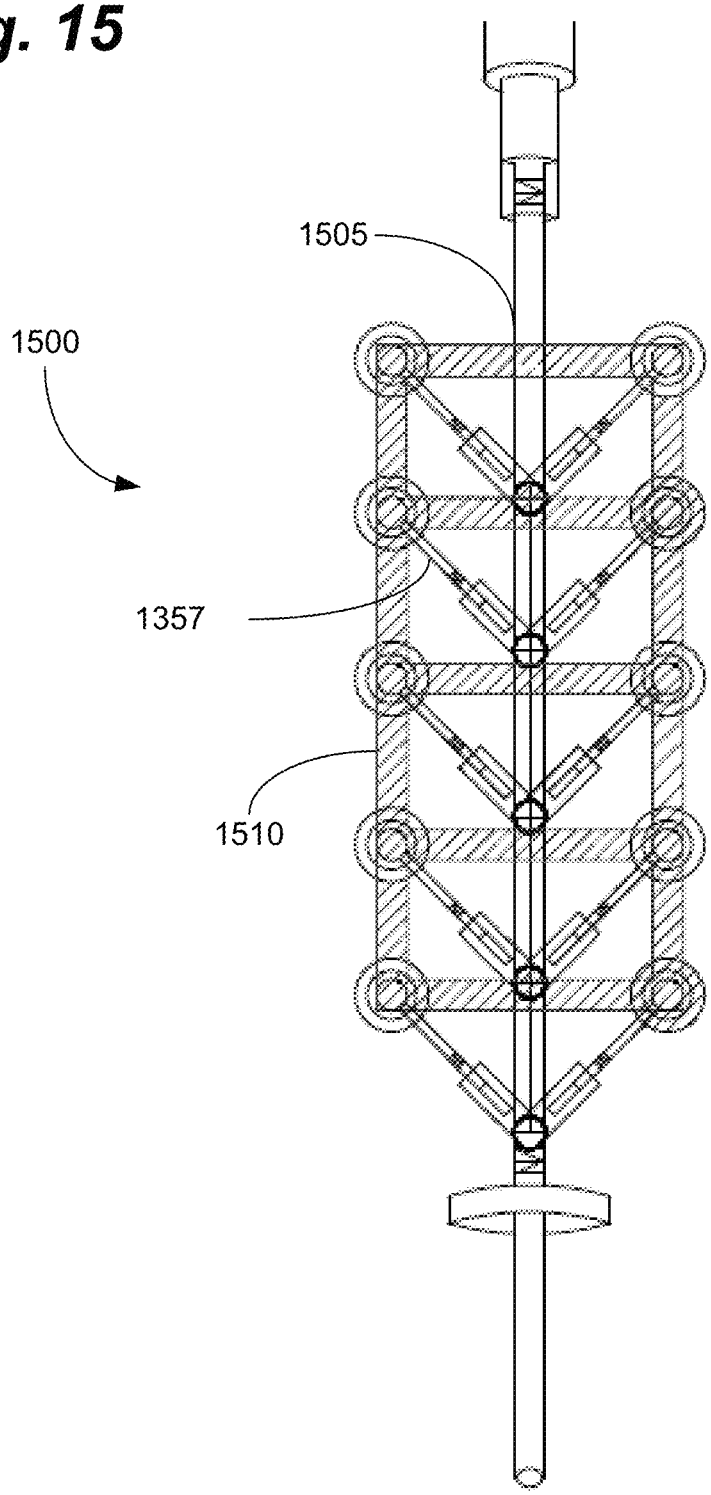
FIG. 15 depicts a rotational control mechanism for the VCRE, in accordance with some embodiments of the present invention.

The control cylinders 1350 can be controlled in a number of ways. As shown in FIG. 15, in some embodiments, the control cylinders 1350 can be controlled by a common control system 1500. The common control system 1500 can comprise one or more control rods 1357 configured to rotate the control cylinders 1350 and a common rail 1505. The control rods 1357 can be mounted on the common rail 1505 to enable the rods 1357 to be moved simultaneously. In some embodiments, the rods 1357 and common rail 1505 can be attached using a linkage to enable rotation of the common rail 1505 to move the rods 1357. The rods 1357 can, in turn, move the control cylinders 1350 simultaneously in a first direction (i.e., moving the assembly up, or away from the crankshaft 120) or a second direction (i.e., moving the assembly down, or towards the crankshaft 120) to lower or raise compression, respectively.

In other embodiments, the control cylinders 1350 can be rotated using, for example and not limitation, hydraulic motors, pneumatic motors, or servo motors. In still other embodiments, the control cylinders can be lifted directly with, for example, ramps, wedges, or cams. In still other embodiments, the control cylinders 1350 can comprise expandable hydraulic or pneumatic cylinders to lift the assembly 1335.

In some embodiments, the control bolts 1315*b* can be connected with one or more tie bars 1360. The tie bars 1360 can prevent flexing and whip induced by the movement of the assembly 1335 and by gravitational, combustion, and reciprocating forces. In some embodiments, as shown in FIG. 15, the system 1500 can comprise a girdle 1510, similar to those used for main bearing girdles, to tie and reinforce the control bolts 1315*b*. The girdle 1510 can be cast or machined, for example, to maintaining the control bolts 1315*b* in a substantially vertical orientation. The girdle 1510 can comprise, for example and not limitation, steel, aluminum, titanium, or alloys thereof.

EXAMPLE 1

As mentioned above, FIG. 1 depicts the VCRE 100 in a low-compression position (LCR) in which the head/block assembly 135 is a distance $h_1$ from the crankcase 105 (and thus, the crankshaft 120). This increases the volume of the combustion chamber 155 and lowers the compression ratio. Similarly, FIG. 2 depicts the VCRE 100 in a high-compression configuration (HCR) in which the height $h_2$ between the head/block assembly 135 and the crankcase 105 has been reduced (or eliminated). This decreases the volume of the combustion chamber 155 and raises the compression ratio. As discussed below, a surprisingly small change in this height h has a significant effect on compression ratio.

For simplicity, assume the VCRE 100 has a stroke of 4 inches and a regular, cylindrical shape. Assume a compression ratio of 10 to 1 with 0.4 inches effective combustion chamber height when the cylinder head is in a "neutral" position (i.e., halfway between $h_1$ and $h_2$). In this configuration, if the $h_2$ is 0.1 inches lower than that neutral position, then the compression ratio is approximately 13.3 to 1 in HCR. Similarly, if $h_1$ is 0.1 inches above the neutral position, the compression ratio is approximately 8 to 1 in LCR (i.e., 4 inches/0.3 inches=13.3 to 1 and 4 inches/0.5 inches=8 to 1). In other words, moving the head/block assembly 0.2 inches changes the compression ratio 66% (i.e., 13.3/8=1.66).

One skilled in the art will recognize this is a significant change in compression ratio. This range of adjustment could enable the use of a broad range of fuel octanes, for example. When the VCRE 100 is combined with a turbocharger, for example, the VCRE 100 can be used to substantially eliminate "turbo lag." In other words, the VCRE 100 can be used to raise the compression ratio of the engine and improve performance until the turbo(s) reach operating speed and begin producing boost. When the turbo(s) have spooled up, the VCRE 100 can then gradually reduce compression ratio to prevent excessive dynamic pressure in the combustion chamber 155. The use of automatic control systems, such as the aforementioned servo motors, can enable the compression ratio to be controlled in real time—as with ignition and cam timing on current engines—to further improve efficiency and power.

Figure 16:
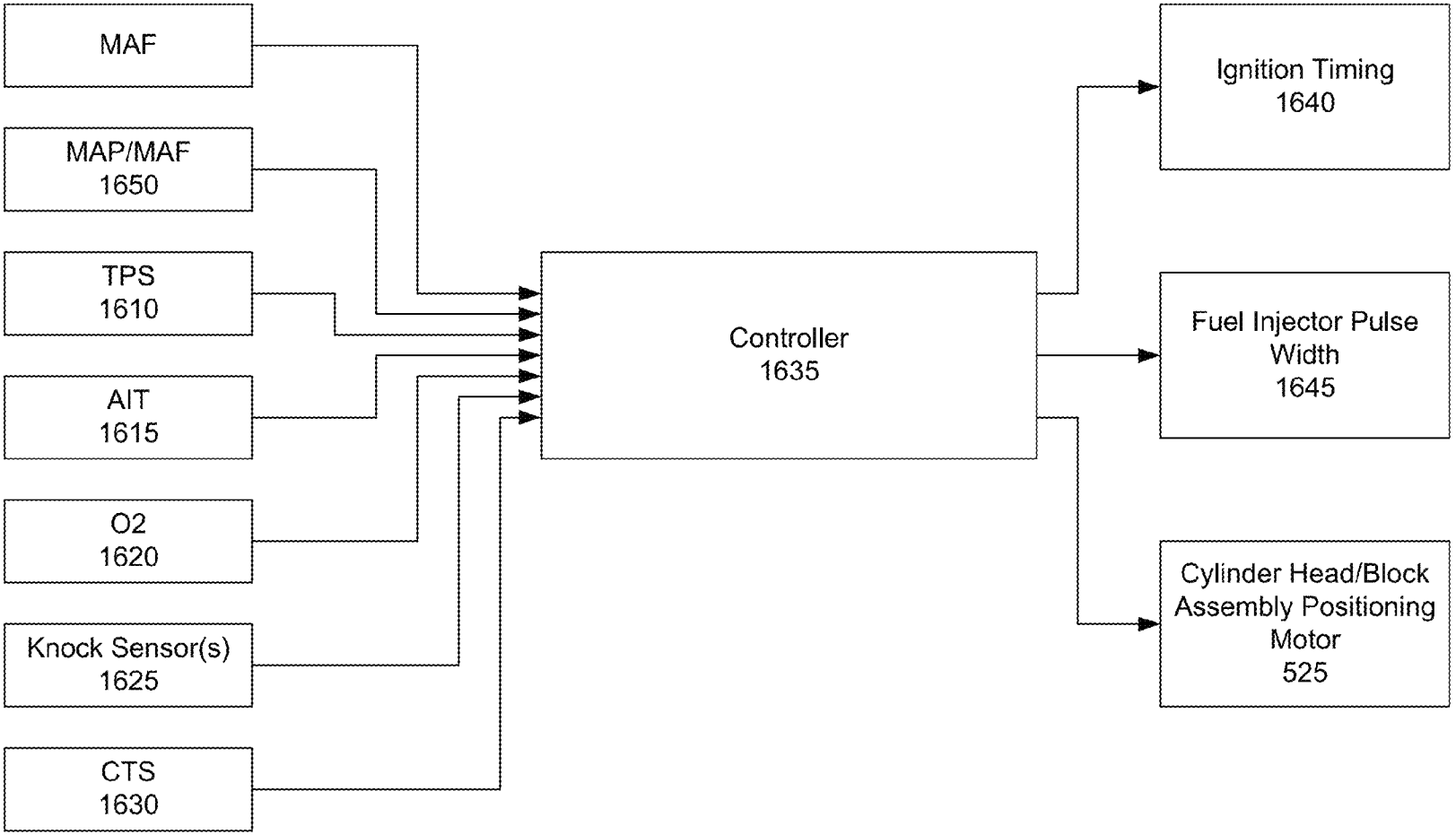
FIG. 16 is a schematic diagram of a control system for use with the VCRE, in accordance with some embodiments of the present invention.

As shown in the simplified schematic of FIG. 16, for example, a control system 1600 can be used to monitor and control the position of the head/block assembly 135 using feedback from various engine sensors, a position sensor (e.g., position sensor 530), and one of the positioning systems 500, 700, 900, 1000 discussed above, for example. The control system 1600 can use normal inputs from one or more sensors such as, for example and not limitation, manifold absolute pressure (MAP) sensors 1605 (or Mass airflow (MAF) sensors), throttle position sensors (TPS) 1610, air intake temperature (AIT) sensors 1615, oxygen (O2) sensors 1620, knock sensors 1625, and coolant temperature sensors (CTS) 1630, among other sensors, to continuously move the head/block assembly 135 to maintain optimum efficiency in conjunction with the position sensor 530. The system 1600 can use a controller 1635, for example, which can comprise a computer or microprocessor to constantly monitor and change engine parameters such as, for example and not limitation, ignition timing 1640, fuel injector pulse width 1645 (i.e., fuel mixture), and head/block assembly 135 position (using one of the control systems described above) to maximize efficiency, maintain engine temperature (i.e., prevent overheating), and to reduce knock. So, for example, the controller may use a servo, or stepper, motor 525 to reposition the head/block assembly 135 in real time.

While several possible embodiments are disclosed above, embodiments of the present invention are not so limited. For instance, while several possible configurations of materials for the frames 305,405 have been disclosed, other suitable materials and combinations of materials could be selected without departing from the spirit of embodiments of the invention. A number of actuators and control systems, in addition to those described above, could be used, for example, without departing from the spirit of the invention. The location and configuration used for various features of embodiments of the present invention can be varied according to a particular engine displacement or configuration that requires a slight variation due to, for example, space or power constraints. Such changes are intended to be embraced within the scope of the invention.

The specific configurations, choice of materials, and the size and shape of various elements can be varied according to particular design specifications or constraints requiring a device, system, or method constructed according to the principles of the invention. Such changes are intended to be embraced within the scope of the invention. The presently disclosed embodiments, therefore, are considered in all respects to be illustrative and not restrictive. The scope of the invention is indicated by the appended claims, rather than the foregoing description, and all changes that come within the meaning and range of equivalents thereof are intended to be embraced therein.

What is claimed is:

1. A system for providing a variable compression ratio engine comprising:

a first frame affixed to the cylinder head/block assembly of a reciprocating internal combustion engine and comprising one of one or more locating pins or one or more locating slots;

a second frame affixed to the crankcase of the engine and in slideable engagement with the first frame and comprising the other of one or more locating pins or one or more locating slots;

wherein the one or more locating pins and the one or more locating slots are in slideable engagement; and wherein the first frame and the second frame enable the head/block assembly to move vertically (i.e., in the y-axis) with respect to the crankcase, but substantially prevent movement in the other two directions (i.e., the x- and z-axes).

2. The system of claim 1, wherein the first frame is bolted to the cylinder head/block assembly; and wherein the second frame is bolted to the crankcase.

3. The system of claim 1, wherein the first frame is integral to the cylinder head/block assembly; and wherein the second frame is integral to the crankcase.

4. A variable compression ratio engine system comprising:

a cylinder head/block assembly comprising:

a cylinder block; and a cylinder head detachably coupled to the cylinder block;

a crankcase in slideable engagement with the cylinder block assembly;

a first frame affixed to the cylinder head/block assembly and comprising one of one or more locating pings or one or more locating slots;

a second frame affixed to the crankcase and in slideable engagement with the first frame and comprising the other of one or more locating pings or one or more locating slots; and a control system for moving the cylinder head/block assembly vertically (i.e., in the y-axis) with respect to the crankcase;

wherein the one or more locating pins and the one or more locating slots are in slideable engagement; and wherein the first frame and the second frame enable the head/block assembly to move vertically with respect to the crankcase, but substantially prevent movement in the other two directions (i.e., the x- and z-axes); and wherein moving the cylinder head/block assembly closer to the crankcase increases the compression ratio of the engine; and wherein moving the cylinder head/block assembly farther from the crankcase decreases the compression ratio of the engine.

5. The system of claim 4, wherein the control system comprises:

an eccentric coupled to the first frame;

a lever, with a first end and a second end, the first end couple to the eccentric;

an actuator coupled to the second end of the lever and configured to move the lever and the eccentric between a first, lower position and a second, higher position;

and a block control post in contact with the eccentric;

wherein the first position configures the engine for high compression ratio (HCR) mode and the second position configures the engine for low compression ratio (LCR) mode.

6. The system of claim 5, wherein the actuator comprises a linear motor.

7. The system of claim 5, wherein the actuator comprises a hydraulic ram.

8. The system of claim 5, wherein the hydraulic ram is driven by one or more selected from the group consisting of:

power steering fluid pressure from a vehicle power steering pump;

oil pressure from the engine; and transmission fluid pressure from a vehicle transmission.

9. The system of claim 4, wherein the control system comprises:

a block control post coupled to the second frame;

a drive gear coupled to the first frame;

a driven gear rotatably coupled to the first frame, with a first position and a second position, and comprising one or more off axis, arcuate slots, in slideable communication with the block control post, each arcuate slot with a first, lower end and a second, higher end; and wherein the drive gear moves the driven gear between the first position and the second position;

wherein the first end of the driven gear is aligned with the block control post in the first position;

wherein the second end of the driven gear is aligned with the block control post in the second position; and wherein the first position configures the engine for high compression ratio (HCR) mode and the second position configures the engine for low compression ratio (LCR) mode.

10. The system of claim 4, further comprising one or more locating pins detachably coupled to the crankcase;

wherein the cylinder head/block assembly further defines one or more holes in slideable engagement with the one or more locating pins; and wherein the slideable engagement of the locating pins and holes enable the head/block assembly to move vertically (i.e., in the y-axis) with respect to the crankcase, but substantially prevent movement in the other two directions (i.e., the x- and z-axes).

11. The system of claim 4, wherein the control system further comprises:

a controller for controlling the position of the block/head assembly with respect to the crankcase; and a position sensor for providing position feedback for the block/head assembly to the controller.

12. The system of claim 4, wherein the control system comprises:

a block control post coupled to the second frame;

a drive motor with a drive gear coupled to the first frame;

a guide plate slideably coupled to the first frame with a first position and a second position comprising:

a rack for geared engagement with the drive gear; and an angled slot, in slideable communication with the block control post, with a first, lower end and a second, higher end; and wherein the drive gear moves the guide plate between the first position and the second position;

wherein the first end of the angled slot is aligned with the block control post in the first position;

wherein the second end of the angled slot is aligned with the block control post in the second position; and wherein the first position configures the engine for high compression ratio (HCR) mode and the second position configures the engine for low compression ratio (LCR) mode.

13. The system of claim 12, wherein the drive motor comprises an electric motor.

14. The system of claim 12, wherein the drive motor comprises a hydraulic motor.

15. The system of claim 14, wherein the hydraulic drive motor is driven by one or more selected from the group consisting of:

power steering fluid pressure from a vehicle power steering pump;

oil pressure from the engine; and transmission fluid pressure from a vehicle transmission.

16. The system of claim 12, wherein the drive motor comprises a vacuum motor.

17. The system of claim 16, wherein the vacuum drive motor is driven using engine vacuum.

18. The system of claim 12, wherein the drive motor comprises a servo motor.

* * * * *